US007699362B2

(12) United States Patent
Taga

(10) Patent No.: US 7,699,362 B2
(45) Date of Patent: Apr. 20, 2010

(54) VEHICLE DOOR LATCH APPARATUS

(75) Inventor: Shigenori Taga, Kanagawa (JP)

(73) Assignee: Ohi Seisakusho Co., Ltd., Yokohama-shi (JP)

( * ) Notice: Subject to any disclaimer, the term of this patent is extended or adjusted under 35 U.S.C. 154(b) by 100 days.

(21) Appl. No.: 10/921,950

(22) Filed: Aug. 20, 2004

(65) Prior Publication Data

US 2005/0040656 A1 Feb. 24, 2005

(30) Foreign Application Priority Data

Aug. 21, 2003 (JP) ..... 2003-297758

(51) Int. Cl.
*E05C 19/10* (2006.01)

(52) U.S. Cl. ..... 292/216; 292/201; 292/DIG. 23

(58) Field of Classification Search ..... 292/216, 292/DIG. 23, DIG. 42, DIG. 53, DIG. 54, 292/DIG. 64
See application file for complete search history.

(56) References Cited

U.S. PATENT DOCUMENTS 5,066,054 A * 11/1991 Ingenhoven ..... 292/201
5,615,564 A * 4/1997 Inoue ..... 70/279.1
5,855,130 A * 1/1999 Rorabacher et al. ..... 70/277
6,349,983 B1 * 2/2002 Dupont et al. ..... 292/201
6,371,537 B1 * 4/2002 Vige et al. ..... 292/201
6,463,773 B1 * 10/2002 Dimig ..... 70/277
6,497,436 B1 * 12/2002 DeBlock et al. ..... 292/216
6,550,826 B2 * 4/2003 Fukushima et al. ..... 292/201
6,698,805 B2 * 3/2004 Erices et al. ..... 292/216
6,964,438 B2 * 11/2005 Koike et al. ..... 292/201
2003/0227177 A1 * 12/2003 Matsuda et al. ..... 292/216

FOREIGN PATENT DOCUMENTS

DE 10100008 A1 * 7/2002
FR 000812972 A2 * 12/1997
JP 2001-182399 A 7/2001
JP 2001-311338 A 11/2001
JP 2003-090158 A 3/2003

* cited by examiner

*Primary Examiner*—Peter M. Cuomo
*Assistant Examiner*—Mark Williams
(74) *Attorney, Agent, or Firm*—Foley & Lardner LLP

(57) ABSTRACT

An actuator has an actuator housing fixed to an open side of a concave accommodating portion of a latch housing in a latch body, and also has a drive source, which is accommodated in the actuator housing, and an open lever for releasing a meshing part from a striker by being release-operated by the drive source. The open lever is accommodated in the actuator housing. A block member blocks a gap between the accommodating portion of the latch housing and the actuator housing.

10 Claims, 3 Drawing Sheets

VEHICLE DOOR LATCH APPARATUS

This application is based on Japanese Patent Application No. 2003-297758, which is incorporated herein by reference.

BACKGROUND OF THE INVENTION

1. Field of the Invention

The present invention relates to a vehicle door latch apparatus having a latch body and an actuator.

2. Description of the Related Art

The vehicle door latch apparatus has a latch body, which is enabled to restrain an opening/closing body, such as a tailgate, in a closed state, and also has an actuator enabled by a drive source, such as a motor, to operate the latch body.

The latch body has a latch housing (cover plate) fixed to the opening/closing body. A meshing part constituted by a latch and a locking plate (ratchet) or the like is accommodated in a concave accommodating portion provided in the latch housing and opened in the top surface thereof.

The actuator is fixed to the open side of the accommodating portion in the latch housing and has an actuator housing (case) in which the drive source is accommodated. An operating member enabled to transmit an operating force of the drive source to a latch means is provided outside the actuator housing (see, for example, JP-A-2003-90158).

In a related apparatus disclosed in JP-A-2003-90158, the operating member is provided outside the actuator housing and exposed to the outside. Thus, rainwater adheres to the operating member. This results in the generation of rust thereon. Further, when the door latch apparatus is assembled to the opening/closing body, the operating member provided outside the actuator housing interferes with a mounting hole of the opening/closing body. Thus, the assemblability thereof is poor. Moreover, a gap is formed between the latch housing and the actuator housing in a state in which the actuator housing is mounted onto the latch housing. Thus, the meshing part is operated through the gap by illicit actions. This is undesirable form the point of antitheft view. Therefore, the configuration of this apparatus is extremely disadvantageous for water-proofness, assemblability, and anti-theft capability.

SUMMARY OF THE INVENTION

In view of the aforementioned problems of the related apparatus, an object of the invention is to provide a vehicle door latch apparatus enabled to enhance water-proofness, assemblability, and antitheft capability thereof.

According to the invention, the aforementioned problems are solved in the following manner.

(1) According to a first aspect of the invention, a vehicle door latch apparatus comprises a latch body, which has a meshing part for restraining an opening/closing body in a closed state by engaging with a striker, and an actuator that is attached to a latch housing having a concave accommodating portion for accommodating the meshing part in the latch body and enabled to operate the meshing part, and that has an actuator housing fixed to an open side of the concave accommodating portion of the latch housing, a drive source, which is accommodated in the actuator housing, and an open lever for releasing the meshing part from a striker by being release-operated by the drive source, the open lever is accommodated in the actuator housing. Also, a block blocks a gap between the accommodating portion of the latch housing and the actuator housing.

(2) According to a second aspect of the invention, an operating force transmission path for transmitting an operating force of the open lever to the meshing part is covered with the actuator housing.

(3) According to a third aspect of the invention, the block member is provided integrally with the actuator housing. Incidentally, the block member is provided like a flange on the actuator housing.

According to the invention, the following advantages are obtained.

(1) According to the first aspect of the invention, the open lever is accommodated in the actuator housing, so that the apparatus is enabled to excel in water-proofness and assemblability.

Moreover, with the provision of the block member for blocking the gap between the accommodating portion of the latch housing and the actuator housing, the open lever and the meshing part can be surely prevented from being illicitly operated. Consequently, the antitheft capability of the apparatus can be enhanced.

(2) According to the second aspect of the invention, the operating force transmission path for transmitting the operating force of the open lever to the meshing part is covered with the actuator housing. Thus, the operating force transmission path can be more surely prevented from being illicitly operated.

(3) According to the third aspect of the invention, the gap between the accommodating portion of the latch housing and the actuator housing can be surely blocked without increasing the number of components.

DETAILED DESCRIPTION OF THE PREFERRED EMBODIMENTS

Figure 1:
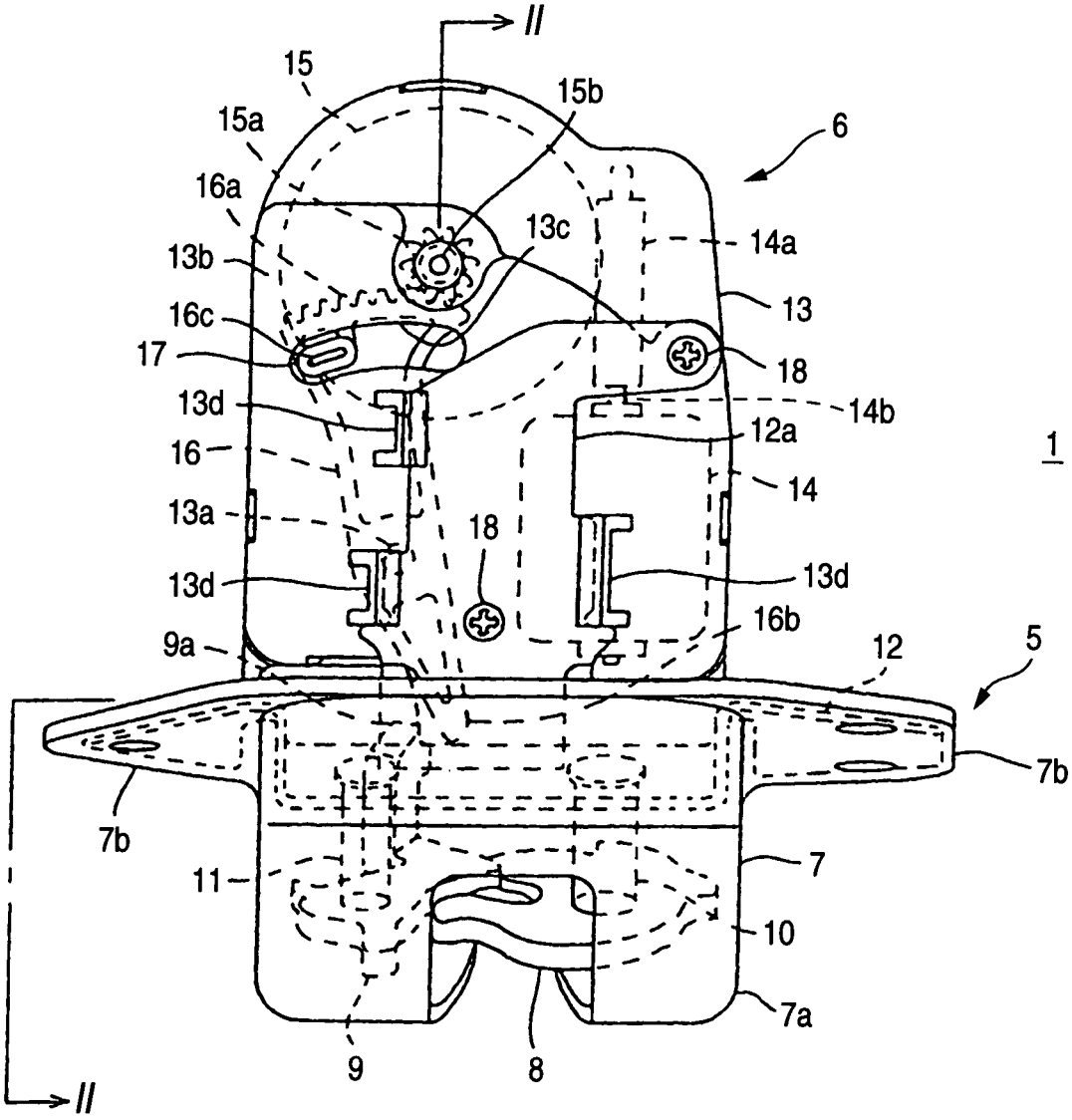
FIG. 1 is a front view showing a door latch apparatus according to the invention.
Figure 2:
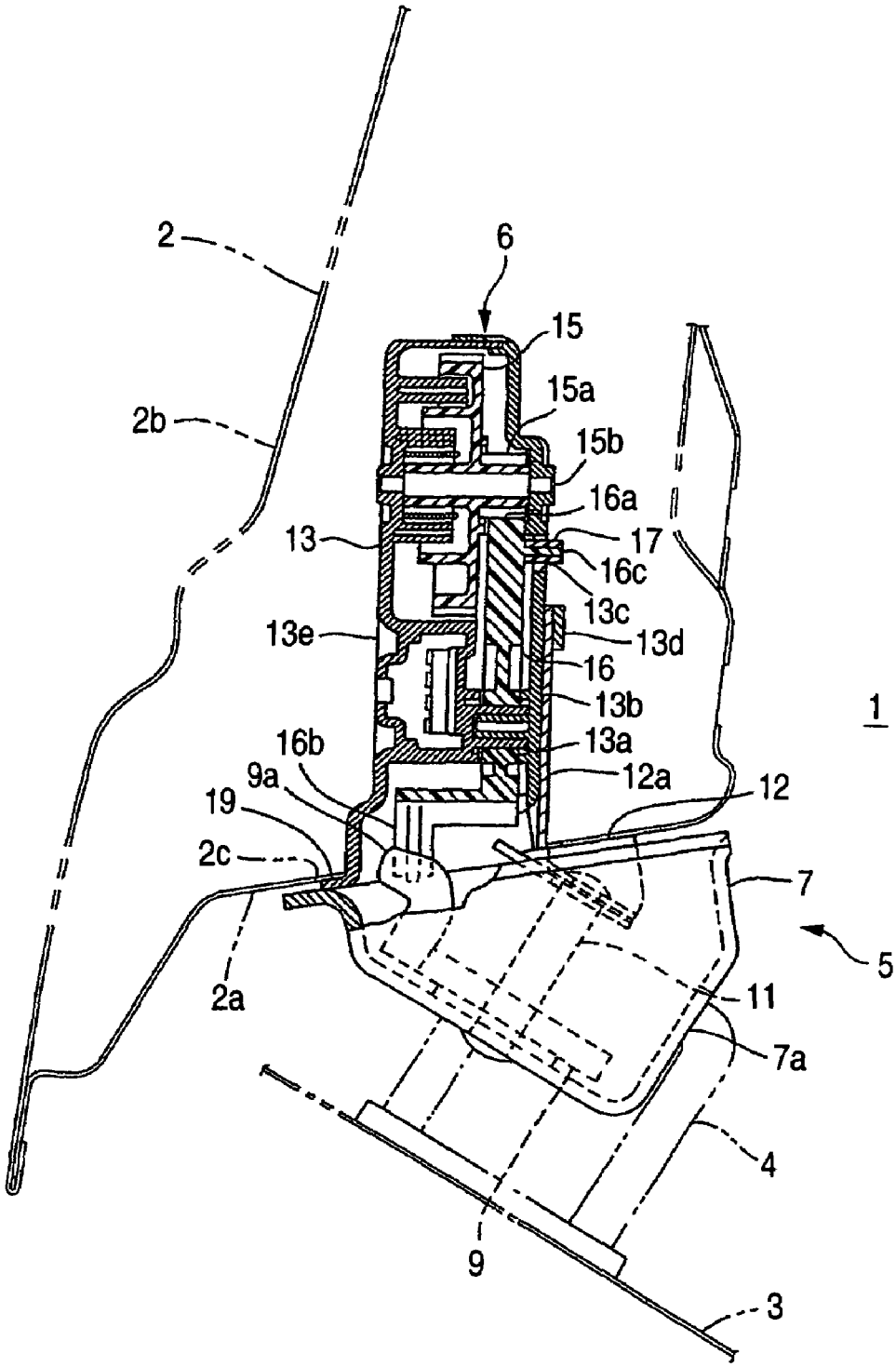
FIG. 2 is a longitudinally sectional/side view taken along line II-II of FIG. 1.
Figure 3:
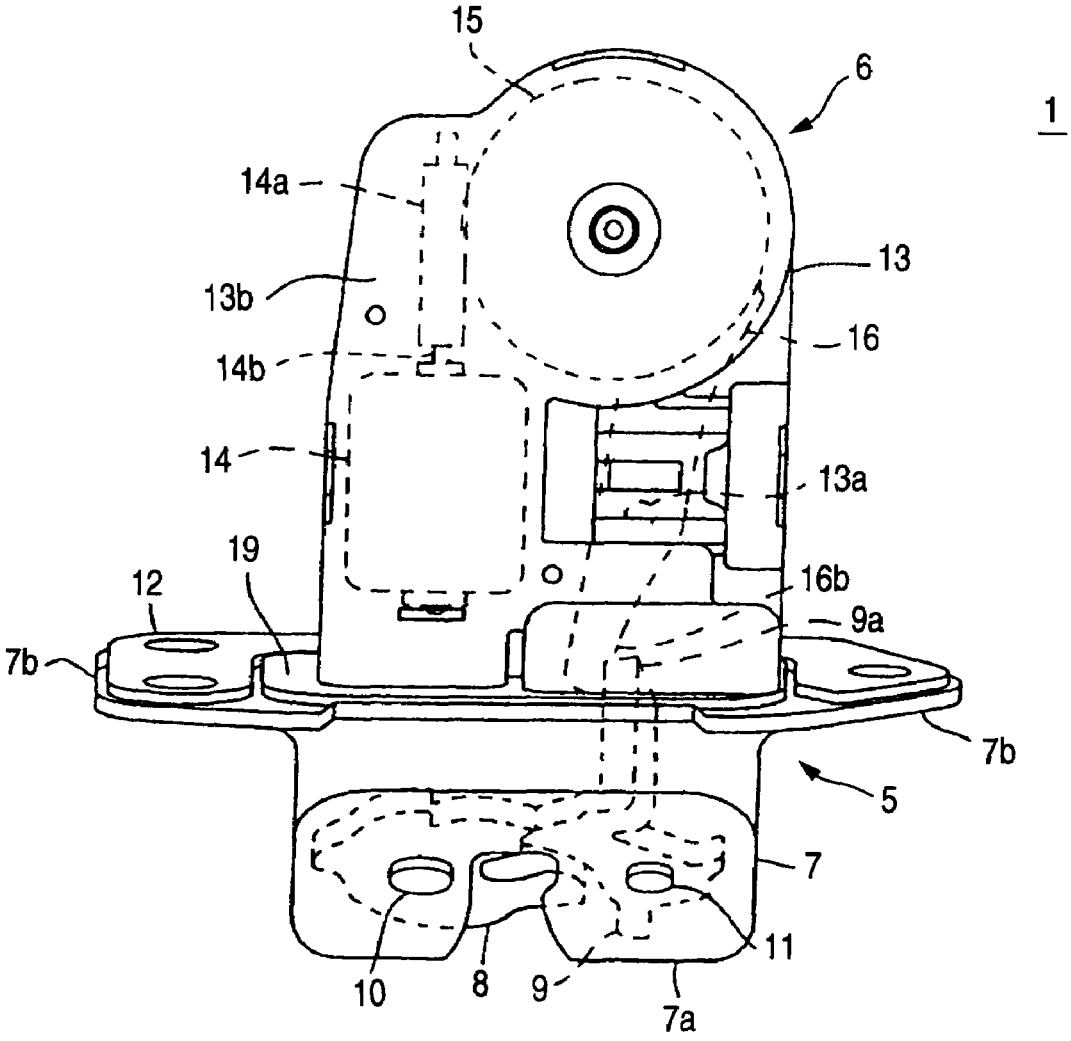
FIG. 3 is a rear view showing the door latch apparatus according to the invention.

FIG. 1 is a front view showing a door latch apparatus according to the invention. FIG. 2 is a longitudinally sectional view taken along line II-II of FIG. 1. FIG. 3 is a rear view showing the door latch. Incidentally, it is assumed that in FIG. 2, the left direction, as viewed in this figure, corresponds to the "backward" direction of the apparatus, and that the right direction, as viewed in this figure, corresponds to the "frontward" direction thereof.

The door latch apparatus (1) is configured by comprising a latch body (5), which is attached to a tailgate (2) serving as an opening/closing body mounted on an upper part of a rear portion of a vehicle body in such a way as to be able to upwardly and downwardly open and close and as to be able to swing, and which has a meshing part enabled to engage with a striker (4) provided at the side of the vehicle body (3) when the tailgate (2) is closed and to restrain the tailgate (2) in a closed state, and also comprising an actuator (6) enables to operate the meshing part of the latch body (5).

The latch body (5) has a metallic latch housing (7) fixed to a lower panel portion (2*a*) of the tailgate (2). The latch housing (7) has a concave accommodating portion (7*a*), which is opened in the top part thereof, and paired left and right mounting pieces (7*b*), (7*b*) provided on upper left and right parts of the accommodating portion (7*a*) and fastened to an outer surface (the bottom surface) of the lower panel portion (2*a*) of the tail gate (2) with plural bolts (not shown).

In the accommodating portion (7*a*) of the latch housing (7), a latch (8), which is enabled to engage with the striker (4) when the tailgate (2) is closed, and a locking plate (9), which engages with the latch (8) when the tailgate (2) is closed, thereby to prevent the latch (8) from being turned in a direction, in which the latch (8) is opened, and to maintain the engagement between the latch (8) and the striker (4), compose the meshing part and are turnably and pivotally supported by support shafts (10), (11) respectively directed in upward and downward directions.

The actuator (6) has an actuator housing (13) made of a synthetic resin, which is fixed to the open side of the accommodating portion (7*a*) of the latch housing (7) through a plate (12) fixed to the top surfaces of the mounting pieces (7*b*), (7*b*) of the latch housing (7). In the actuator housing (13), a motor (14) serving as the drive source, a worm wheel (15) supported by a support shaft (15*b*) directed in a front-rear direction and meshed with a worm (14*a*), which is provided on an output shaft (14*b*) of the motor (14), and an open lever (16) having a gear portion (16*a*) meshed with a small gear (15*a*) provided on the worm wheel (15).

The actuator housing (13) is fixed to the latch housing (7) of the latch body (5) by fitting both left and right side edges of an erected piece (12*a*) provided on the plate (12) in among three claw portions (13*d*) substantially L-shaped and provided integrally with one side surface portion (13*b*) directed frontwardly, that is, toward a vehicle interior side and by being fastened to the erected piece (12*a*) of the plate (12) with two screws (18).

A flange-like block member (19) for blocking the gap between the lower portion of the actuator housing (13) and the accommodating portion (7*a*) of the latch housing (7) in a state, in which this member is fixed to the latch housing (7), is provided on the lower portion of the actuator housing (13) in such a manner as to be integral therewith.

The open lever (16) is supported by the support shaft (13*a*), which has a nearly central part provided in the actuator housing (13) and is directed in the front-rear direction, in such a way as to be able to laterally turn and as to be able to swing. The open lever (16) also has the top edge, in which the gear portion (16*a*) is provided, and a lower portion on which a crank-like abutting portion (16*b*) is provided in such a way as to be able to abut against a release portion (9*a*) that is provided on a rear portion of the locking plate (9) and directed upwardly. Additionally, an operating portion (16*c*) is provided under the gear portion (16*a*) in such a way as to protrude from an arcuate operating hole (13*c*) that is provided in one side surface portion (13*b*) of the actuator housing (13) and directed laterally.

The abutting portion (16*b*) of the open lever (16) is shaped like a crank. Thus, even in a case of the configuration in which the releasing portion (9*a*) of the locking plate (9) disposed in the rear of the actuator housing (13), that is, toward the other side surface portion (13*e*) facing a vehicle exterior side, an operation of the open lever (16) can surely be transmitted to the locking plate (9) by causing the abutting portion (16*b*) of the open lever (16), which is disposed toward the one side portion (13*b*) of the actuator housing (13), to surely abut against the releasing portion (9*a*) of the locking plate (9).

The operating hole (13*c*) is shaped like a circular arc centered at the support shaft (13*a*) . Further, a buffer member (17) formed of an elastic body, such as a rubber one, is fitted onto the operating portion (16*c*) of the open lever (16). The buffer member (17) abuts against the left end edge of the operating hole (13*c*) when the open lever (16) is placed at an inactive position shown in FIGS. 1 and 3. Furthermore, when the open lever (16) is turned from the inactive position in a releasing direction (a clockwise direction in FIG. 1, and a counter-clockwise direction in FIG. 3) by a predetermined amount of turn, the buffer member (17) abuts against the right end edge of the operating hole (13*c*). Consequently, the amount of turn of the open lever (16) is regulated.

Incidentally, although this embodiment regulates the amount of turn of the open lever (16) by providing the buffer member (17) on the operating portion (16*c*) of the open lever (16), this buffer member (17) is not always necessary.

In a case where the buffer member (17) is not needed, another buffer member is provided at the worm wheel (15). This buffer member is made to abut against a stopper portion provided at an appropriate place on the actuator housing (13). Thus, an amount of turn of the worm wheel (15) is regulated. Consequently, the amount of turn of the open lever (16) is regulated.

The operating portion (16*c*) is provided in the vicinity of the gear portion (16*a*), which is placed away from the support shaft (13*a*) of the actuator housing (13). Thus, an operation thereof in a lateral direction is easy to perform. Moreover, the operating portion (16*c*) is projected frontwardly from the operating hole (13*c*) provided in the one side surface portion (13*b*). Consequently, a manual operation thereof is enabled without using a tool or the like at all from the vehicle interior side.

The open lever (16) is accommodated in the actuator housing (13) so that only the operating portion (16*c*) is exposed from the operating hole (13*c*) of the actuator housing (13).

An abutting part at which the abutting portion (16*b*) of the open lever (16) abuts against the releasing portion (9*a*) of the locking plate (9), that is, an operating force transmission path for transmitting an operating force of the open lever (16) is covered with the actuator housing (13) in such a way as not to be exposed to the outside from the door latch apparatus (1). Consequently, this embodiment is configured so that operating members enabled to operate the locking plate (9), which are provided in the related apparatus, are not provided outside the actuator housing (13) at all.

The mounting of the door latch apparatus (1) on the tailgate (2) is performed by fixing the mounting piece (7*b*) of the latch housing (7) onto the exterior of the lower panel portion (2*a*) of the tailgate (2) by bolts in a state in which the actuator (6) assembled to the latch body (5) is inserted from the outside (or lower side) of the lower panel portion (2*a*) of the tailgate (2) into the tailgate (2) through amounting opening (2*c*) provided in the lower panel portion (2*a*).

As described above, the open lever (16) is accommodated in the actuator housing (13), and the path for transmitting the operating force of the open lever (16) is covered with the actuator housing (13). This is extremely effective in enhancing the water-proofness and in miniaturization thereof. Also, in the case of mounting the door latch apparatus (1) onto the tailgate (2), because no operating members are provided outside the actuator housing (13), occurrence of interference of the operating member with an edge or the like of a mounting opening (2*c*) of the tailgate (2) is prevented. Consequently, the assemblability can be enhanced. Furthermore, the open lever (16) is accommodated in the actuator housing (13). Additionally, the gap between the lower portion of the actuator housing (13) and the accommodating portion of the latch housing (7) is blocked by the block member (19). Thus, the open lever (16) and the locking plate (9) can surely be prevented. Consequently, the antitheft capability can be enhanced.

Further, because the block member (19) is disposed between the plate (12) and the actuator housing (13), as shown in FIG. 3, the block member (19) is sandwiched between the latch housing (7) and the lower panel (2*a*) (see FIG. 2) in a state in which the door latch apparatus (1) is mounted onto the lower panel (2*a*) of the tailgate (2). Thus, the block member (19) is pushed against the latch housing (7). Consequently, the block member (19) can surely block the gap therebetween.

Next, an operation of this embodiment according to the invention is described. When an operation switch (not shown) constituted by a touch sensor provided on an outer panel (2*b*) of the tailgate (2) is operated, electric power is supplied to the motor (14) of the actuator (13) according to a control unit (not shown). The motor (14) is rotated in a predetermined direction. When the motor (14) is rotated, the open lever (16) is turned from the inactive position in the releasing direction through the worm (14*a*), the worm wheel (15), the small gear (15*a*), and the gear portion (16*a*) . The abutting portion (16*b*) abuts against a side surface of the releasing portion (9*a*) of the locking plate (9) to thereby operate the locking plate (9) from an engagement position, at which the locking plate (9) engages with the latch (8), in the releasing direction in which the locking plate (9) is released from the latch (8). Consequently, the engagement between the latch (8) and the striker (4) is canceled. Thus, the tailgate (2) can be opened.

For example, in a case where the motor (14) of the actuator (6) cannot be driven due to a failure of an electrical system, a lid (not shown) provided in a vehicle interior side trim (not shown) of the tailgate (2) is opened from the vehicle interior side. Then, a hand is inserted from this portion. The operating portion (16*c*) of the open lever (16), which projects from the operating hole (13*c*) of the actuator housing (13), is moved in the releasing direction by being manually operated. Consequently, the open lever (16) is turned from the inactive position in the releasing direction thereby to cause the locking plate (9) to perform a releasing operation. Thus, the tailgate (2) can be opened.

Incidentally, although the door latch apparatus (1) of the invention, which is applied to tailgate mounted onto the rear portion of the vehicle in such a way as to be able to open and close and swing, has been described, the apparatus of the invention can be applied to an opening/closing body other than the tailgate, for instance, a door or a slide door, which is provided in a side portion of a vehicle in such a way as to be able to open and close.

Additionally, although the block member (19), which is provided like a flange on the lower portion of the actuator housing (13) in such a manner as to be integral therewith, has been described, instead, the block member (19) may be provided on the plate (12) by shaping the plate (12) in such a way as to be able to block the gap between the lower portion of the actuator housing (13) and the accommodating portion (7*a*) of the latch housing (7). Alternatively, the block member can be formed of another member.

What is claimed is:

1. A vehicle door latch apparatus comprising:

a latch body comprising a latch housing and a meshing part, wherein the meshing part is configured to engage with a striker, wherein the latch housing comprises an accommodating portion for accommodating the meshing part within the latch housing;

an actuator comprising an actuator housing, a drive source located within the actuator housing, and an opening lever configured to release the meshing part from the striker, wherein the drive source is configured to operate the opening lever and wherein the opening lever is located within the actuator housing, wherein the actuator housing is arranged relative to an open side of the accommodating portion of the latch housing such that a gap is formed between the accommodating portion of the latch housing and the actuator housing; and a plate-shaped blocking member that is provided integrally with the actuator housing and is sandwiched between the actuator housing and the accommodating portion of the latch housing such that it blocks and eliminates the gap, wherein the blocking member is configured to fit between the latch body and a body of a vehicle, wherein the actuator housing is fixed to the open side of the accommodating portion of the latch housing through the blocking member, wherein the vehicle door latch apparatus is configured to be inserted from an outside of a lower panel portion of a tailgate of the vehicle into the tailgate through a mounting opening provided in the lower panel portion, wherein the blocking member is sandwiched between the latch housing and the lower panel portion in a state in which the door latch apparatus is mounted onto the lower panel portion.

2. The vehicle door latch apparatus according to claim 1, wherein an operating force transmission path for transmitting an operating force of the opening lever to the meshing part is covered with the actuator housing.

3. The vehicle door latch apparatus according to claim 1, wherein the blocking member is provided as a flange-like member on the actuator housing.

4. The vehicle door latch apparatus according to claim 1, wherein the blocking member is configured to fit between the latch body and a panel portion of a tail gate.

5. The vehicle door latch apparatus according to claim 1, wherein the actuator housing comprises an operating hole that provides access to the opening lever.

6. The vehicle door latch apparatus according to claim 5, wherein the opening lever has an operating portion that is configured to fit within the operating hole.

7. A vehicle door latch apparatus comprising:

a latch body comprising a latch housing and a meshing part, wherein the meshing part is configured to engage with a striker, wherein the latch housing comprises an accommodating portion for accommodating the meshing part within the latch housing;

an actuator comprising an actuator housing, a drive source located within the actuator housing, and an opening lever configured to release the meshing part from the striker, wherein the drive source is configured to operate the opening lever and wherein the opening lever is located within the actuator housing, wherein the actuator housing is arranged relative to an open side of the accommodating portion of the latch housing such that a gap is formed between the accommodating portion of the latch housing and the actuator housing; and a plate-shaped blocking member sandwiched between the actuator housing and the accommodating portion of the latch housing such that it blocks and eliminates the gap, wherein the blocking member is configured to fit between the latch body and a body of a vehicle;

wherein the actuator housing is fixed to the open side of the accommodating portion of the latch housing through the blocking member;

wherein the blocking member is located on an exterior surface of the vehicle door latch apparatus, wherein the vehicle door latch apparatus is configured to be inserted from an outside of a lower panel portion of a tailgate of the vehicle into the tailgate through a mounting opening provided in the lower panel portion, wherein the blocking member is sandwiched between the latch housing and the lower panel portion in a state in which the door latch apparatus is mounted onto the lower panel portion.

8. The vehicle door latch apparatus according to claim 7, wherein the blocking member is provided as a flange-like member on the actuator housing.

9. The vehicle door latch apparatus according to claim 7, wherein the actuator housing comprises an operating hole that provides access to the opening lever.

10. The vehicle door latch apparatus according to claim 9, wherein the opening lever has an operating portion that is configured to fit within the operating hole.

* * * * *